US009355622B2

(12) United States Patent
Powers

(10) Patent No.: US 9,355,622 B2
(45) Date of Patent: May 31, 2016

(54) ANCHORING SYSTEM FOR A STRING IN A MUSICAL INSTRUMENT

(71) Applicant: TAYLOR-LISTUG, INC., El Cajon, CA (US)

(72) Inventor: Andrew Taylor Powers, Carlsbad, CA (US)

(73) Assignee: TAYLOR-LISTUG, INC., El Cajon, CA (US)

( * ) Notice: Subject to any disclaimer, the term of this patent is extended or adjusted under 35 U.S.C. 154(b) by 0 days.

(21) Appl. No.: 14/086,839

(22) Filed: Nov. 21, 2013

(65) Prior Publication Data

US 2015/0135929 A1 May 21, 2015

(51) Int. Cl.
*G10D 3/12* (2006.01)

(52) U.S. Cl.
CPC ..... *G10D 3/12* (2013.01)

(58) Field of Classification Search
USPC ..... 84/304, 298, 299, 297, 307
See application file for complete search history.

(56) References Cited

U.S. PATENT DOCUMENTS

| | | | | |
|---|---|---|---|---|
| 4,197,779 | A * | 4/1980 | Holman | G10D 3/12 84/297 R |
| 5,477,764 | A | 12/1995 | Carrico | |
| 6,166,309 | A * | 12/2000 | Hoshino | 84/298 |
| 7,154,032 | B2 * | 12/2006 | Burchfield | 84/304 |
| 7,394,005 | B1 * | 7/2008 | Anderson | G10D 3/12 84/297 R |
| 7,534,945 | B2 * | 5/2009 | Babicz | 84/298 |

OTHER PUBLICATIONS

EPO Extended European Search Report dated Dec. 22, 2015, for EPO Patent Application No. 14190262.7.

* cited by examiner

*Primary Examiner* — Christopher Uhlir
(74) *Attorney, Agent, or Firm* — Patterson & Sheridan, LLP

(57) ABSTRACT

A system for anchoring a guitar string comprising a guitar top, a bridge fixed to the guitar top, and at least one aperture extending through the bridge and top for receiving an end of a string with a ball attached thereto. A bridge pin has a body that is insertable into the aperture. The body has two spaced-apart legs forming a space therebetween wide enough to accommodate the string but not the ball. A rear side of the legs has matching anchoring surfaces that are constructed and arranged to receive and retain the ball when the string is in tension.

10 Claims, 6 Drawing Sheets

ANCHORING SYSTEM FOR A STRING IN A MUSICAL INSTRUMENT

BACKGROUND OF THE INVENTION

1. Field of the Invention

The present invention relates to musical instruments. More particularly, the invention relates to stringed instruments, like guitars. More particularly still, the invention relates to an anchoring system for guitar strings.

2. Description of the Related Art

FIG. 1 is a plan view of a 6 string guitar showing the strings 1 anchored at a first end at a head stock 5 where they are tightened with tuners 10 and anchored at a second end at a bridge 15 with bridge pins 20. Traditionally, the strings on fretted instruments are either single core wires or in the case of larger diameter strings, a core wire with another wire wrapped around it. In either case, a cylindrical "ball" is attached to one end of the string to facilitate anchoring the string to the instrument. The body of the string is secured to the anchoring ball by wrapping the string around the ball and back onto itself where it is twisted, thereby forming a loop which captures the cylindrical ball. This arrangement creates an extra stiff area near the end of the string with a larger diameter than the body of the string and the extra stiff area increases in length with the diameter of the string. FIG. 2 is a partial section view of a prior art anchoring arrangement. Visible in the Figure are a guitar top 25, a reinforcing member 30 below the top, a bridge 35 affixed to the top and an aperture 40 extending through the bridge, top and reinforcing member into an interior of the instrument. A string 1 is supported by a saddle 55 and has an enlarged diameter portion 2 terminating in a ball 3 on its end. The string is inserted through the aperture and held at a front side of the aperture by a pin 45. In the example shown in FIG. 2, the section of the string extending through the aperture is housed in a vertical slot 50 formed in the bridge, top and reinforcing member in a manner whereby it conjoins the aperture. In another example (not shown), the slot is formed in the pin rather than in the aperture. In either case, the string 1 is held between the pin 45 and the aperture 40 and the pin must be precisely sized to fit in the aperture in a manner that retains the string while it is being tensioned and played.

This conventional arrangement of the mounting hole, mounting pin, and saddle, create geometry that can force the string into an undesirably small radius bend made worse by the stiffened end condition affected by the anchoring ball's retaining wrap. In extreme cases, when the string is of very large diameter, such as those found on a bass guitar, or in cases where the components of the bridge are exceptionally small or in close proximity, the radius of the string's bend over the saddle cannot be accomplished, leading to improper functioning of the instrument. Additionally, the arrangement can cause the large diameter area of the string to contact the saddle, thereby preventing the string from "sounding" properly. What is needed is an improved anchoring system for a string, in particular one that can be utilized in instances of large diameter strings and/or instruments having limited space for anchoring components.

SUMMARY OF THE INVENTION

The present invention generally includes a system for anchoring a guitar string comprising a guitar top, a bridge fixed to the guitar top, and at least one aperture extending through the bridge and top for receiving an end of a string with a ball attached thereto. A bridge pin has a body that is insertable into the aperture. The body has two spaced-apart legs forming a space therebetween wide enough to accommodate the string but not the ball. A rear side of the legs has matching anchoring surfaces that are constructed and arranged to receive and retain the ball when the string is in tension.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
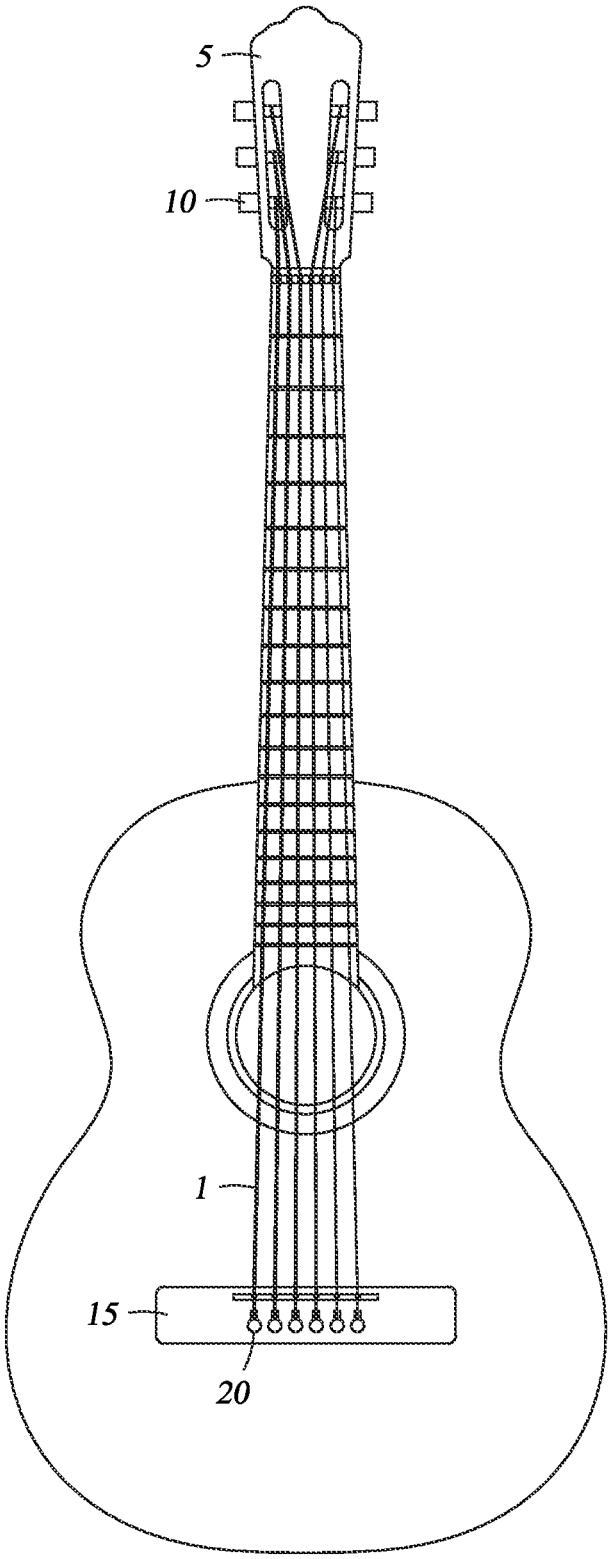
FIG. 1 is a plan view of a guitar.
Figure 2:
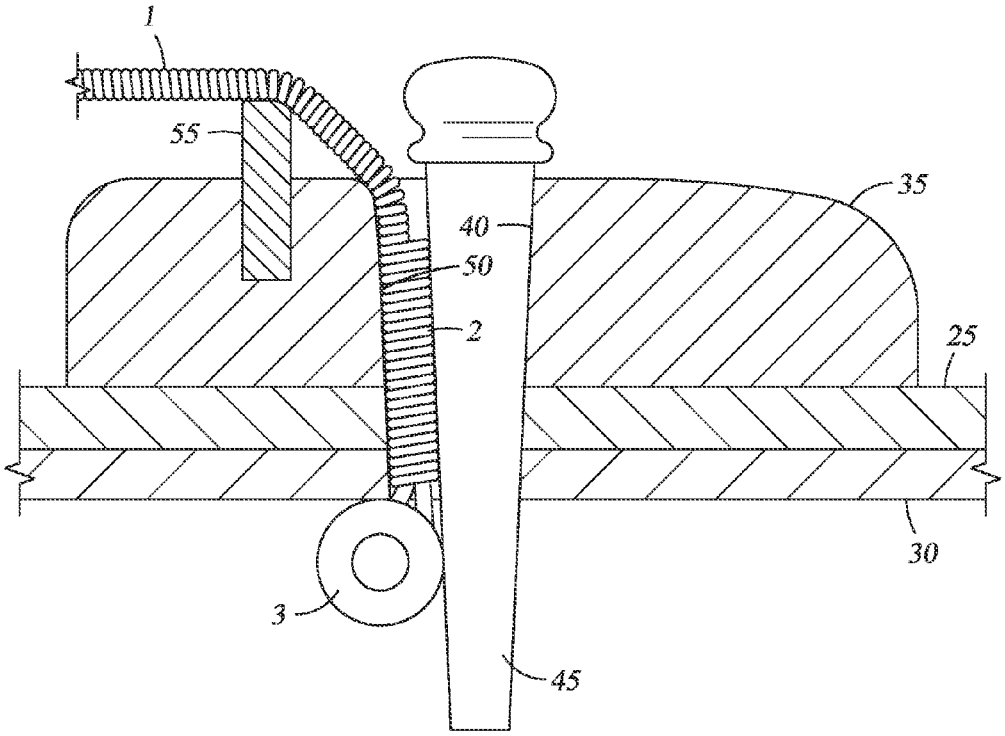
Fig. 2 (PRIOR ART)
FIG. 2 is a partial section view of a prior art mounting arrangement.
Figure 3:
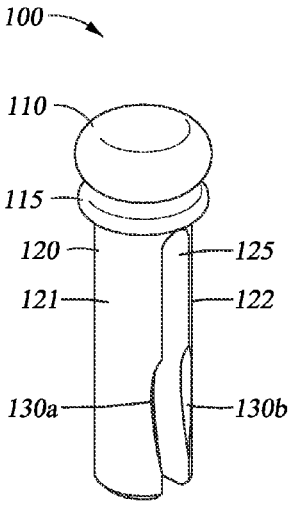
FIG. 3 is a perspective view of a bridge pin according to one aspect of the invention.
Figure 4:
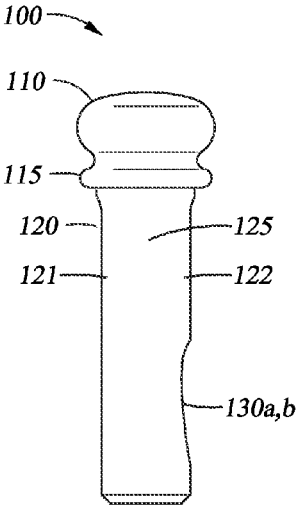
FIG. 4 is a side view of the pin of FIG. 3.
Figure 5:
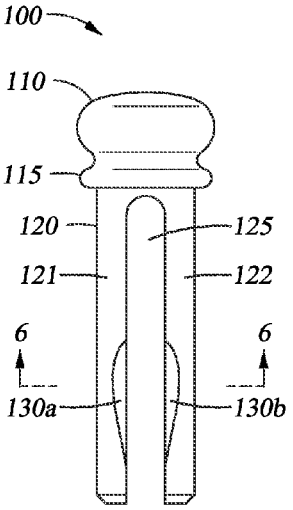
FIG. 5 is a rear view of the pin illustrating anchoring surfaces formed in the legs of the pin.
Figure 6:
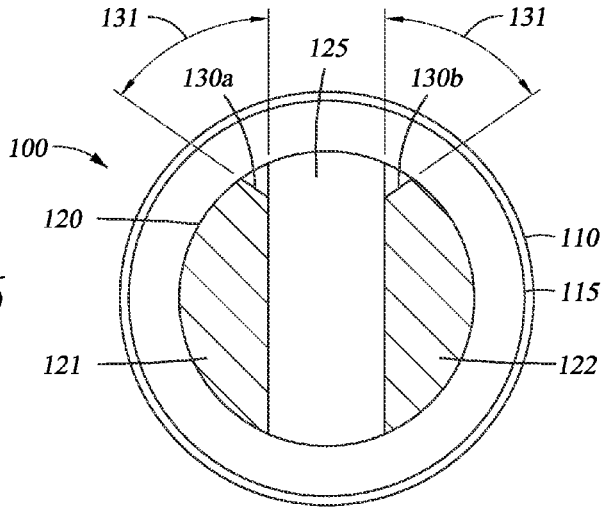
FIG. 6 is a section view taken along a line 6-6 of FIG. 5.

FIG. 3 is a perspective view of a bridge pin 100 according to one aspect of the invention. In the embodiment shown the pin has a top portion 110 and an enlarged diameter portion 115 therebelow. The pin includes a body 120 having two legs 121, 122 that are separated to create a space 125 therebetween for accommodating a string as will be explained herein. Considering FIGS. 3-6 together, the legs 121, 122 include an anchoring arrangement made up of matching anchoring surfaces 130*a*, 130*b* formed at a rear and inside surface of each leg 121, 122. The surfaces are designed to retain a ball end of a string as the string is tensioned and pulled against the surfaces. In FIG. 4 the surfaces 130*a*, 130*b* appear as a profile. FIGS. 3 and 5 illustrate the surfaces 130*a*, 130*b* as matching, angled surfaces formed in an inside, rear edge of each leg in a manner wherein they appear as a single tear drop shape best appreciated in FIG. 5. The angle 131 created by the surfaces is shown in FIG. 6, a section view taken along a line 6-6 of FIG. 5. In the embodiment of FIG. 6, angle 131 is about 45 degrees although the exact angle can vary based upon a number of factors including the size of the ball and the length of the pin legs that extend below the top of the instrument.

Figure 7:
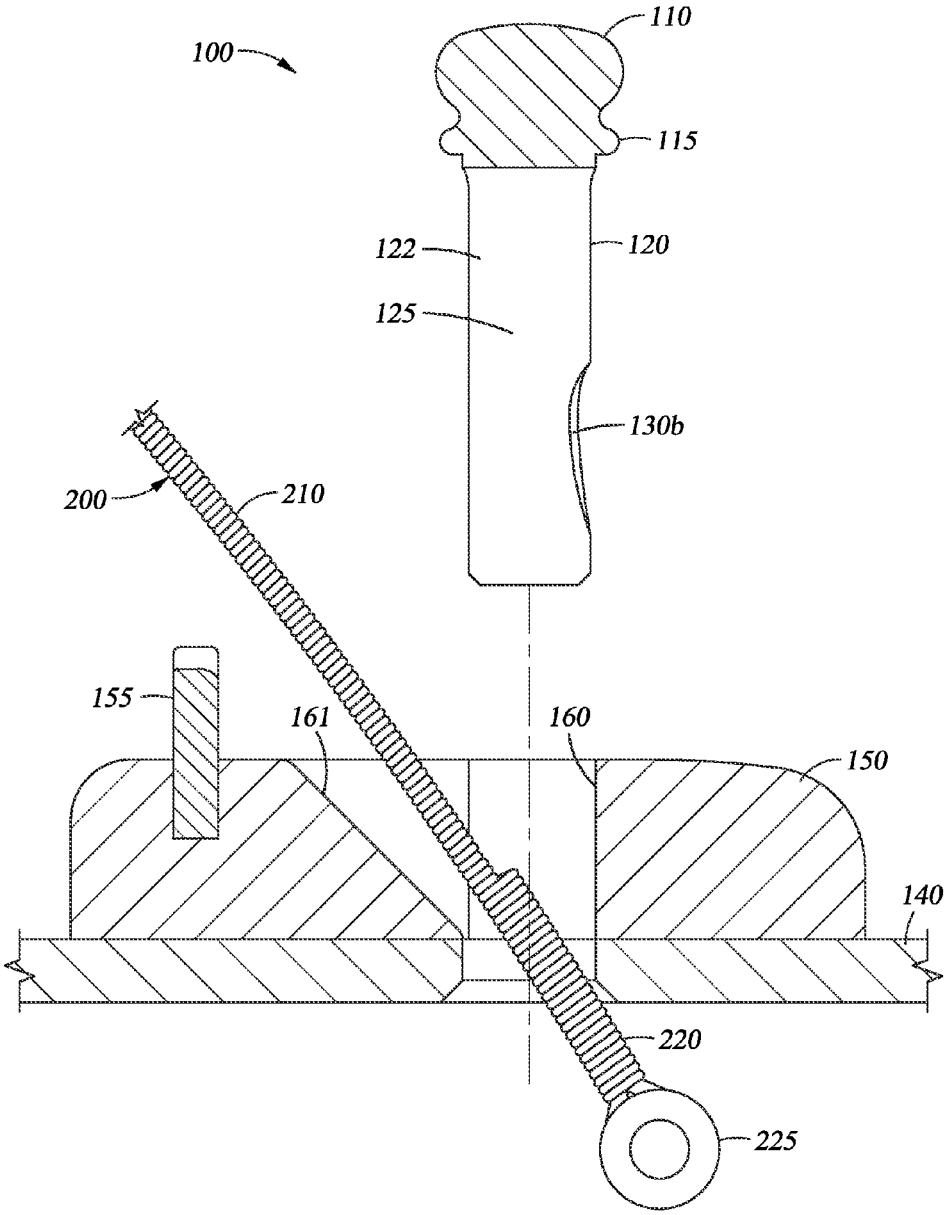
FIG. 7 is a partial section view of an instrument showing a top, bridge, saddle, pin and a string extending through an aperture in the bridge and top.

FIG. 7 is a partial section view of an instrument showing the various portions of the anchoring system prior to installation of the pin 100 and tensioning of a string 200. A typical string is shown with a first diameter 210 and a larger diameter 220 portion having a cylindrical ball 225 attached at an end. Shown in section is an instrument top 140, a bridge 150 attached the top and a saddle 155 installed in the bridge. The saddle's purpose is to provide an end point for the string's vibration at the correct location for proper intonation and to transfer the vibrations through the bridge into the top wood of the guitar. For this reason it is necessary that the ball end of the string transitions to the smaller diameter 210 prior to contact with the bridge. An aperture 160 extends through the bridge and top and the string 200 is shown inserted through the aperture in a manner wherein the ball is housed in the body of the instrument. Rather than a vertical slot, the aperture includes an angled opening 161 in the form of a slot or notch in the direction of the saddle to reduce bending of the tensioned string as it moves from an interior of the instrument to the saddle 155. A pin 100 as described in reference to FIGS. 3-6 is shown above the aperture 160. While not shown in FIG. 7, an optional bridge reinforcement plate can be utilized in a way that sandwiches the top between the bridge and an additional piece of strong hardwood glued to the underside of the top.

Figure 8:
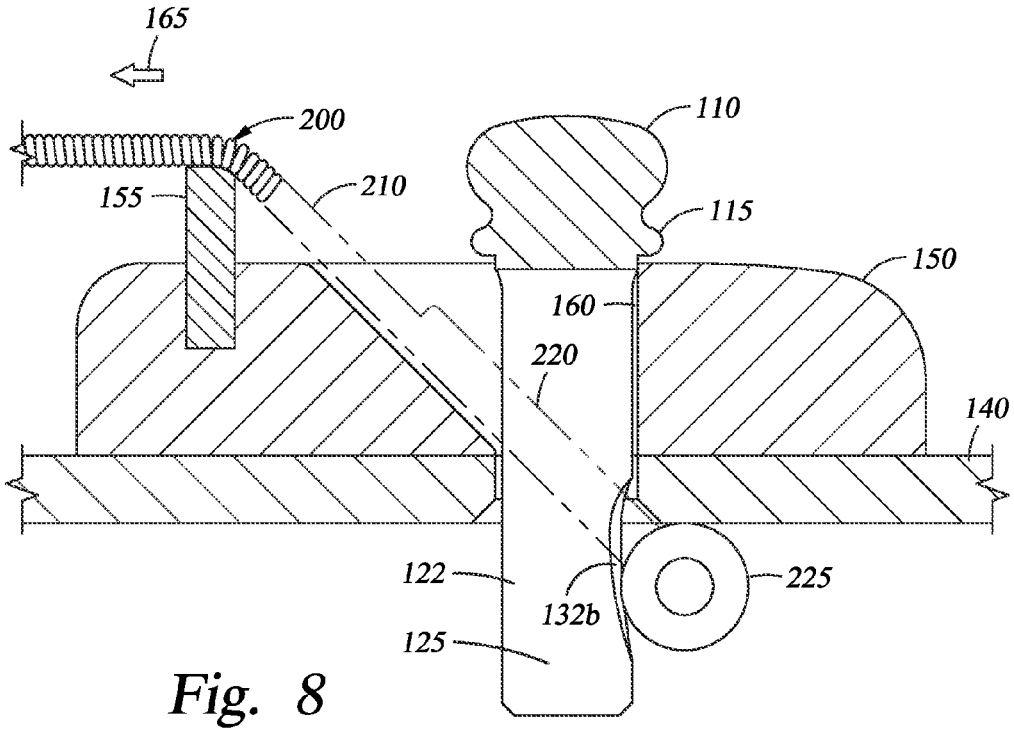
FIG. 8 is a partial section view showing a string prior to tensioning.
Figure 9:
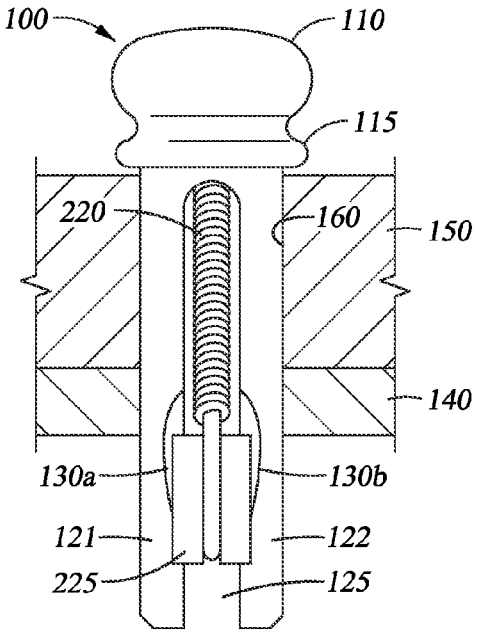
FIG. 9 is a rear view thereof.

FIG. 8 is a partial section view of the anchoring system showing a string 200 prior to tensioning and FIG. 9 is a rear view thereof. The string is shown inserted through the aperture 160 in the bridge and top and the pin is shown inserted in the aperture in a manner whereby the string runs along the angled portion 161 of the aperture and extends through space 125 formed between the legs 121, 122 of the pin 100. Anchoring surface 130*b* of the pin is visible and the ball 225 is shown adjacent that surface. Arrow 165 illustrates the direction of the string 200 as it is tightened from an opposite end and tension is applied. In FIGS. 8 and 9 the ball is not in compression contact with the surfaces 130*a*, 130*b* of the pin legs and the legs have not been deformed due to forces between the pin and the ball. However, the tear drop shape of the surfaces, with their exaggerated length in the downward direction, serves as a guide to the ball 225 as the string 200 is initially tightened.

Figure 10:
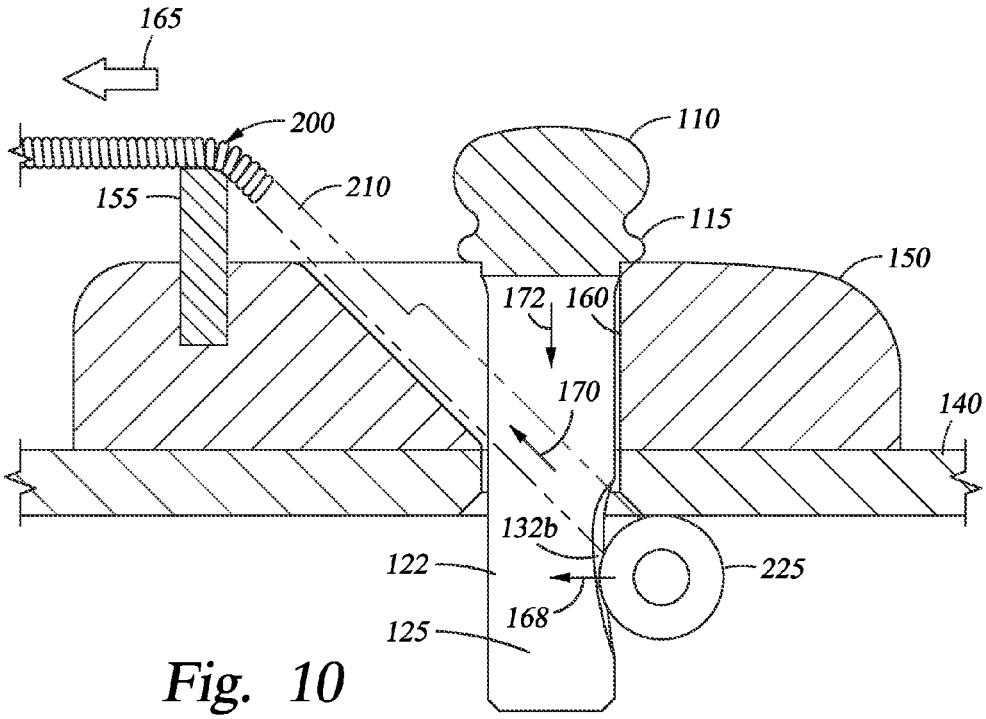
FIG. 10 is a partial section view showing the string retained after tensioning and FIG. 11 is a rear view thereof.
Figure 11:
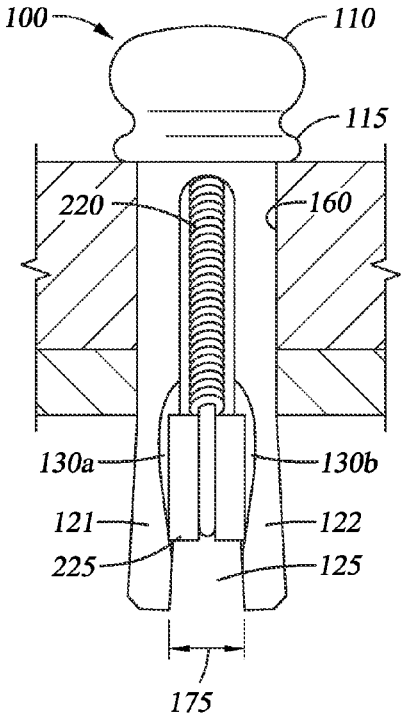

FIG. 10 is a partial section view of the anchoring system showing the string 200 retained after tensioning. FIG. 11 is a rear view. The string 200 is shown in a tensioned condition and forces developed in the anchoring system are shown with arrows 168, 170, 172. For example, the tensioning action has pulled the ball 225 into the pin 100 via surfaces 130*a*, 130*b* (130*b* visible in FIG. 8). Those forces are shown with arrows 168, 170 and have also caused the ball to be firmly in contact with a lower surface 141 of top 140. The same forces serve to create a downward force (arrow 172) on the pin 100, thereby seating the enlarged diameter portion 115 of the pin firmly on the upper surface of the bridge 150. Considering FIG. 11, the force between the ball and the anchoring surfaces of the pin has deformed the legs in the area of the ball and surfaces and enlarged the space between the legs as shown by distance 175. In this manner, the pin, and with it the string is further anchored in the aperture.

In operation, one embodiment of the anchoring system includes the following steps: A ball-end of a string is inserted through an aperture and into the body of an instrument, like a guitar. Typically, the aperture is formed in a bridge and top of the guitar and includes an angled slot. A pin like the one described herein is then inserted into the aperture in a manner whereby the string is straddled by two spaced-apart legs of the pin whereby the string enters the front of the pin and exists the rear of the pin. Thereafter, the string is tightened and put into tension and the ball is urged into contact with anchoring surfaces at the rear of the legs of the pin. The surfaces, along with an underside of the guitar top, serve to anchor the ball end of the string in the instrument. In doing so, room is provided for the thickened end of the string prior to the string crossing a saddle.

While simultaneously anchoring the string, the slot in which the string passes through alleviates severely tight radius bends in the string, allowing a more relaxed end condition and the elimination of distortion of the string, critical to accurate musical function. Additionally, this arrangement provides clearance for the increased diameter of the doubly wrapped end of the string, and provides a more stable anchoring for the string overall which improves tuning stability of the complete instrument, enhanced clarity of the notes, and improves sustain of the string's vibration.

Unlike conventional string mounting, the present invention utilizes a straight sided installation hole serving to anchor the string under the top and bridge at a point furthest from the saddle, with a space formed through the pin through which the string passes. The bridge features a clearance slot on the forward side of the hole. The bridge pin features a straight sided profile which mates to the straight sided, cylindrical hole. By utilizing a straight sided pin and matching straight sided bore, as well as a clearance ramp located entirely in the bridge, accurate manufacturing is greatly facilitated.

While the foregoing is directed to embodiments of the present invention, other and further embodiments of the invention may be devised without departing from the basic scope thereof, and the scope thereof is determined by the claims that follow. For example, the invention as described presumes a bridge on an instrument top and an aperture that extends through both the bridge and top. It will be understood that these components can be combined or the invention can be used without a bridge. While the invention might typically be used with a 6 string guitar it is equally useful with a base guitar having fewer strings of a mandolin, 12 string guitar or any stringed instrument utilizing a ball that requires anchoring at one end.

The invention claimed is:

1. A system for anchoring a guitar string comprising:

a guitar top;

a bridge fixed to the guitar top;

at least one aperture extending through the bridge and top for receiving an end of a string, the end having a ball attached thereto;

a bridge pin insertable into one of the at least one apertures, the pin having a larger diameter portion for retaining the pin on the guitar top and a body extendable into the aperture, the body having two spaced-apart legs forming a through-hole therebetween wide enough to accommodate the string but not the ball, the through-hole defined by a closed top, two closed sides and an open lower portion to permit insertion of the string into the through-hole, the through-hole extending substantially the length of the legs, a rear side of the legs adjacent the through-hole having matching anchoring surfaces, the surfaces constructed and arranged to receive and retain the ball when the string is in tension.

2. The system of claim 1, further including an angled slot extending from a surface of the bridge adjacent a saddle to a point adjacent the top.

3. The system of claim 1, whereby the ball is further retained by a lower surface of the guitar top.

4. The system of claim 1, whereby the surfaces are opposing surfaces.

5. The system of claim 1, whereby the surfaces are angled surfaces about 45 degrees from an inside surface of each leg.

6. The system of claim 1, whereby when the string is tensioned, the through-hole between the legs is enlarged in the area of the ball.

7. The system of claim 1, whereby the surfaces together form a tear drop shape.

8. The system of claim 7, whereby the surfaces are further constructed and arranged to guide the ball into the pin as the ball is tensioned.

9. The system of claim 1, wherein the pin is urged downwards due to the ball and the surfaces when the string is in tension.

10. A system for anchoring a guitar string comprising:

a bridge pin insertable into an aperture formed in a top of a guitar, the pin having a larger diameter portion for retaining the pin on the guitar top and a body extendable into the aperture, the body having two spaced-apart legs forming a through-hole therebetween wide enough to accommodate a string but not a ball mounted on an end of the string, the through-hole defined by a closed top, two closed sides and an open lower portion to permit insertion of the string into the through-hole, the through-hole extending substantially the length of the legs, a rear side of the legs adjacent the through-hole having matching anchoring surfaces, the surfaces constructed and arranged to receive and retain the ball when the string is in tension.

* * * * *